United States Patent [19]

Johnson et al.

[11] Patent Number: 4,769,964

[45] Date of Patent: Sep. 13, 1988

[54] SELF-ALIGNED AND LEVELED, INSULATED, DRYSTACK BLOCK

[76] Inventors: Stanley D. Johnson, 8230 E. Valley Vista Dr.; Weldon R. Johnson, 8226 E. Keim Dr., both of, Scottsdale, Ariz. 85253

[21] Appl. No.: 620,448

[22] Filed: Jun. 14, 1984

[51] Int. Cl.[4] ..... E04C 1/04; E04G 21/00

[52] U.S. Cl. ..... 52/405; 52/309.12; 52/444; 52/593; 52/747

[58] Field of Search ..... 52/405, 309.12, 443, 52/444, 593, 309.8, 747, 404

[56] References Cited

U.S. PATENT DOCUMENTS

| | | | |
|---|---|---|---|
| 13,110 | 6/1855 | Till . | |
| 1,836,408 | 12/1931 | Sutton . | |
| 2,199,112 | 4/1940 | O'Leary | 52/584 |
| 2,241,079 | 5/1941 | Whitten . | |
| 2,371,201 | 3/1945 | Wells . | |
| 2,835,126 | 5/1958 | Paolella | 52/444 |
| 2,900,814 | 8/1959 | Carson . | |
| 3,204,381 | 9/1965 | Perreton | 52/309.12 |
| 3,292,331 | 12/1966 | Sams | 52/405 |
| 3,391,507 | 7/1968 | Downing | 52/314 |
| 3,394,517 | 7/1968 | Caterina | 52/436 |
| 3,546,833 | 12/1970 | Perreton | 52/405 |
| 3,780,484 | 12/1973 | Muse | 52/585 |
| 3,885,363 | 5/1975 | Whittey | 52/405 |
| 3,936,987 | 2/1976 | Calvin | 52/309 |
| 3,956,862 | 5/1976 | Alexandre | 52/286 |
| 4,098,040 | 7/1978 | Riefler | 52/404 |
| 4,123,881 | 11/1978 | Muse | 52/100 |
| 4,148,166 | 4/1979 | Toone | 52/309.12 |
| 4,263,765 | 4/1981 | Maloney | 52/562 |
| 4,269,013 | 5/1981 | West | 52/405 |
| 4,295,810 | 10/1981 | Dennert | 425/110 |
| 4,297,816 | 11/1981 | Kella | 52/125 |
| 4,348,845 | 9/1982 | Iannarelli | 52/405 |
| 4,498,266 | 2/1985 | Perreton | 52/405 |

FOREIGN PATENT DOCUMENTS

| | | | |
|---|---|---|---|
| 2440466 | 3/1976 | Fed. Rep. of Germany | 52/405 |

OTHER PUBLICATIONS

Construction Methods, Jun. 1948, pp. 96, 97.

*Primary Examiner*—John E. Murtagh
*Attorney, Agent, or Firm*—LaValle D. Ptak

[57] ABSTRACT

A construction block has interior, tapered wall cells. The tapering of the walls provides precisely maintained interior geometry for a long life time of use of the molds employed in manufacture of such block. Insertable cores of precise dimension to fit intimately within such cells and to come into intermittent contact with similar cells in adjacent blocks in a running course of said blocks and with similar cells in adjacent blocks in adjacent courses of said cells provide for the erection of a standing wall from drystacked running courses of such block wherein such running courses are self-aligned and self-leveling. The intimate contact of the insertable cores permit the formation of open-gapped interlocks between blocks and running courses, which open-gapped interlocks are converted to closed-gapped interlocks when a wall erected of such running courses is coated with a surface bonding cement.

23 Claims, 3 Drawing Sheets

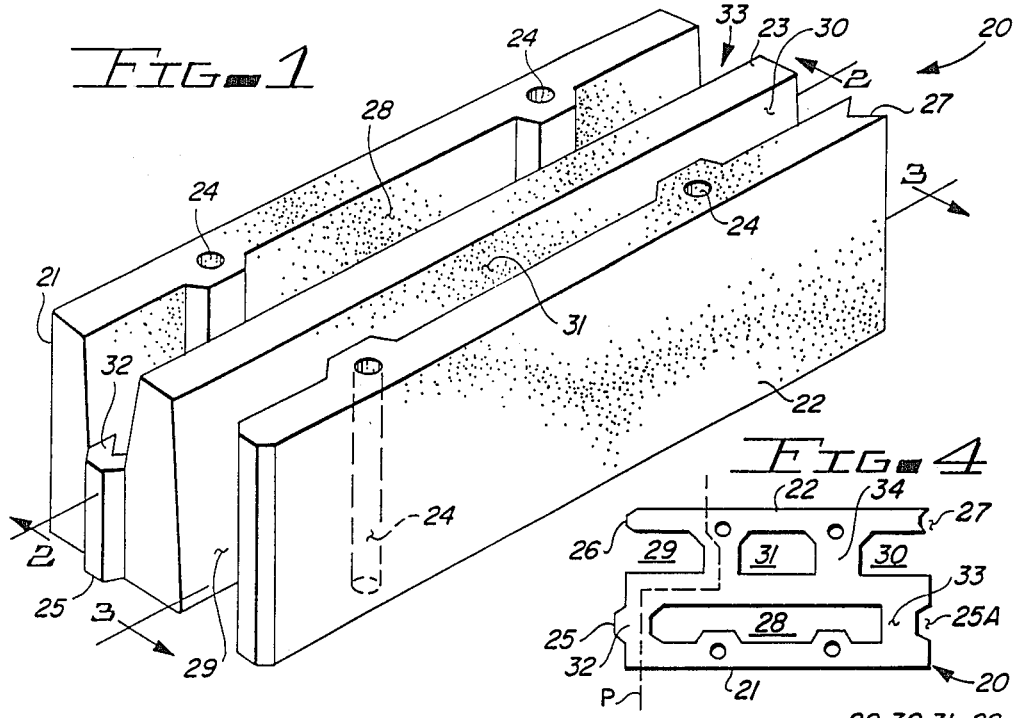
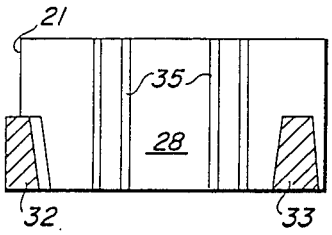
FIG. 2
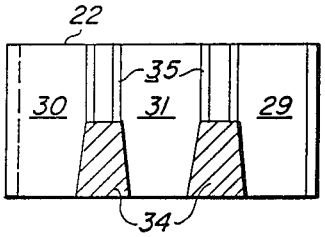
FIG. 3
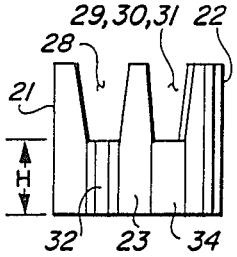
FIG. 5
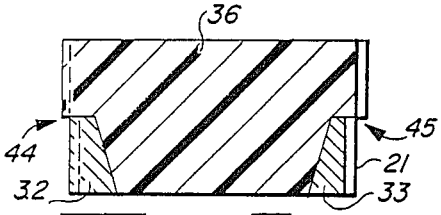
FIG. 7
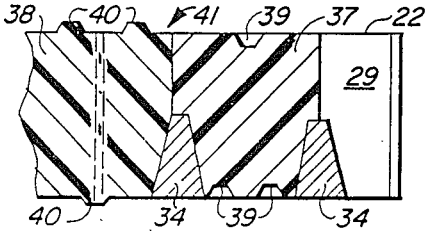
FIG. 8
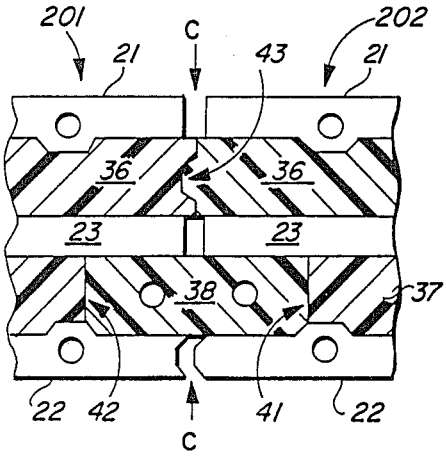
FIG. 9

FIG. 6
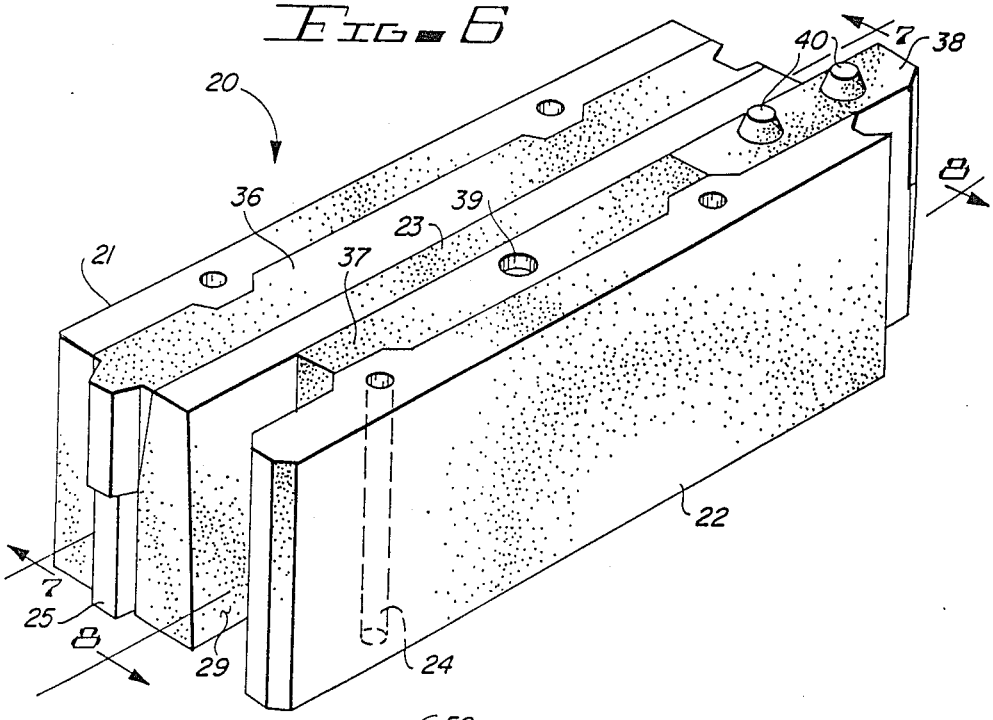
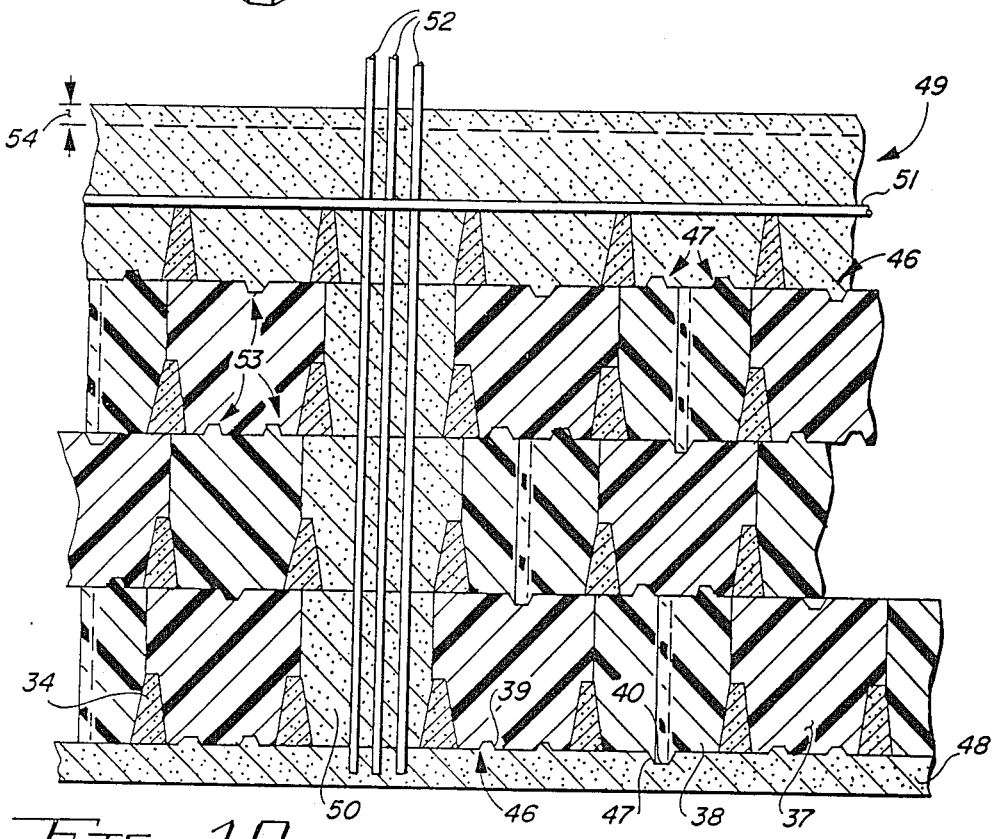
FIG. 10

SELF-ALIGNED AND LEVELED, INSULATED, DRYSTACK BLOCK

BACKGROUND

Technical Field

The invention relates to the field of construction blocks which may be drystacked, i.e. without the use of mortar, in running courses to erect a free-standing wall. The invention particularly relates to drystacked construction block which includes the means for self-alignment and self-leveling of a running course of said block. The invention further relates to construction block having reduced thermal energy transfer between the outside walls of such block.

BACKGROUND ART

The prior art is replete with construction blocks designed to have projecting tongues or spurs which mate with channels or grooves in adjacent block. While such spurs and channels may increase the mechanical integrity of a wall structure fabricated from such blocks, the inventors of these various improvements have invariably overlooked the fact that construction block is generally an item which is manufactured by molding. Because the concrete employed in molding such block is highly abrasive, the molds rapidly wear and the dimension of the block produced in these molds is not precise; and blocks tend to grow in length and thickness the longer the mold employed in manufacturing them is utilized.

Some prior art construction block has been provided with interior passageways suitable for use as electrical conduit. However, the incorporation of such integral conduit within a block wall generally required the use of a variety of different block types and required that the mason erecting the wall be familiar with the planned electrical runs anticipated for installation after the wall was erected.

Many prior art construction blocks contained hollow cells which could be filled with an insulating material. Where such cells were prefilled, the block was difficult to handle by the mason employing such insulated block. Masons generally prefer a block which can be handled with one hand so that the other hand is free to hold a tool or carry a second block.

Much of the prior art related to construction block has been shown to be impractical for use in actual construction activity since the the peculiarities of the block design prevented the construction of a wall which would meet with the requirements of the local building code. In particular, many of the prior art construction blocks were incapable of employment in a wall in which bond beams and grout cells are required to be incorporated in the wall structure.

It is an objective of the present invention to effectively utilize the characteristics of molded block construction to provide a construction block having selected and predetermined configuration aspects of precise dimensional character.

It is a further objective of the invention to utilize these predetermined and precise configuration characteristics of the construction block of the invention to provide for means for utilizing the block in running courses which are of constant, predeterminable lengths and, in which running courses, the blocks are self-aligning and self-levelling.

It is another objective of the invention that the means whereby the blocks are made self-levelling and self-aligning in running courses and whereby the length of a running course is predeterminably fixed shall also provide for reduced thermal transfer between one outer wall of the construction block to the other outer wall.

DISCLOSURE OF THE INVENTION

The teachings herein are directed to both method and apparatus. A method is set forth for erecting a drystack block wall, which wall is self-levelling and self-aligning. One who practices the method must first provide himself with a sufficient quantity of hollow celled block for the wall to be erected. He must also provide precision dimension, interlocking cell cores to be inserted within selected hollow cells of the blocks used in erecting the wall. He inserts a cell core in a selected hollow cell of each block such that a core in a first, drystacked, running course of block comes into interlocking alignment with the cell core and an adjacent block in a second running course of the walls utilizing the precision dimensions and the interlocking characteristics of the cell cores, one is able to maintain the wall to be erected in vertical and horizontal alignment. This is done by aligning cell core to cell core so as to control the position of each block relative to each adjacent block in the wall to be erected. It is the mating and interlocking of these cell cores rather than the contact of the various surfaces of one block with those of another which maintains the wall level and aligned.

By providing hollow celled block having interlocking ends, each person practicing the method may mechanically interlock adjacent blocks in a running course so as to increase the shear strength of the wall.

By selecting the precision dimension interlocking cell core to be of insulating material, the rate of thermal conduction through the blocks comprising the wall will be reduced.

It is practical in practicing the methodology set forth that all hollow cells within the construction block shall be filled with insulating cell cores.

By selecting construction block to have a continuous central web, the methodology sets forth the means whereby one-half or both sides of the construction block may be insulated or only one-half of the construction block may be insulated while the remaining half of the block is filled with a mass aggregate which makes for a stronger wall construction and may be utilized as a thermal flywheel within buildings heated by solar energy or the like.

When the wall structure has been completed by drystacking the construction block in running courses, a surface bonding cement may be applied to the surfaces of the wall to mechanically interlock the various blocks and running courses together and to provide a rigid and stable wall structure.

The apparatus disclosed represents an improvement in molded building blocks, each of which have first and second outside walls and a central web generally parallel to these outside walls. The improvement reduces the thermal energy transfer between these outside walls and makes the blocks self-levelling and self-aligning when drystacked in running courses to erect a standing wall. The improved molded building blocks comprise in combination, first tapered wall interior cells formed between a first outside wall and the central web of the block during the molding of The tapering of the walls of the interior cells the blocks. maintains precise dimensions of the cells from one block to another during the molding of such blocks.

The improved block further comprises tapered wall cores which are inserted within the aforementioned interior cells. The cores are precisely dimensioned to mate with the cells in intimate contact with the tapered walls thereof. These cores extend beyond the longitudinal bounds of the blocks so that when the blocks, with the cores in place, are emplaced in running courses for the erection of a standing wall, intimate contact is maintained between adjacent cores such that a gap is maintained between adjacent blocks in a running course of blocks and the precise dimensions of these cores precisely establishes the running length of a standing wall erected by running courses of these blocks with the cores inserted therein.

These tapered wall cores have top and bottom surfaces which are precisely maintained a predetermined distance apart. This is so that intimate contact will be maintained between the cores in a first running course of block with adjacent cores in a second running course of the block. This intimate contact between upper and lower surfaces of adjacent cores will determine the height of a standing wall erected by such running courses as well as the level of such running courses since the dimensions between top and bottom surfaces of the cores are precisely maintained.

Means are provided for interlocking a core in a first running course of block with an adjacent core in a second running course of block so that lineal integrity of the running courses is maintained without skewing of the individual blocks making up these running courses.

The improved block is provided with reduced height transverse webs for coupling one of the outside walls to the central web. The reduced height is determined by the strength of the coupling which is required between the outside wall and the second web. Also, the reduced height limits the volume of the thermal conduction path between the outside wall and the central web.

The improved construction block includes a second tapered wall interior cell formed on the other side of the central web to produce and maintain precise dimensions within such cell in the manner already disclosed. Additional precisely dimensioned tapered wall cores mate with the second cells and make intimate contact with the tapered walls thereof. As before, the second cores extend beyond the longitudinal bounds of the blocks. In this way again, when such blocks are placed in running courses, gap is maintained between adjacent blocks while intimate contact is maintained between adjacent cores. Since the cores, like the earlier mentioned cores are precisely dimensioned, their intimate contact along the length of a running course precisely determines the length of that running course.

The top and bottom surfaces of the second cores are also precisely maintained a given distance apart to maintain the height of the standing wall and the level of the running courses in cooperation with the first cores earlier noted.

As before, reduced height transverse webs couple the second outside wall of the block to the central web. Again the reduced height of the transverse web limits the volume of the thermal conduction path between the second outside wall and the central web. To provide an elongated thermal path between the first and second outside walls of the construction block, the transverse web connecting the first outside wall to the central web is displaced from the transverse webs connecting the second outside wall to the central web. The manner of this displacement is such that a transverse plane passed through the block would find the webs displaced on opposite sides of that transverse plane.

In molding the block, interlock means are provided to form an open-gap interlock between adjacent blocks when the blocks are emplaced in a running course. These open-gap interlocks are then available to form a closed-gap interlock upon application of a surface bonding cement to the surface of the running courses comprising the standing wall. Closure of these gaps by the surface bonding cement increases the shear strength of the wall so erected.

Where it is desired that the construction block shall be drystacked but shall not receive an application of surface bonding cement in order to preserve some particular, attractive surface characteristic of the construction block, a spacer strip means for interlocking simultaneously with first cores in a first running course of the block with adjacent first cores in a second running course of the block is provided. This spacer not only provides a grout channel between such running courses but its interlocking with the adjacent cores maintains the lineal integrity of these running courses, preventing the skewing of individual blocks within the courses.

The invention provides the means for monitoring dimensional changes in the blocks, which changes are experienced over the course of molding a multiplicity of blocks as the surfaces of the molds employed to manufacture the block are worn away by the abrasive surfaces of the concrete used. The cores to be inserted within the tapered wall cells of the block will not extend beyond the longitudinal bounds of the block if it is over long nor will they fit precisely within an undersized cell.

BRIEF DESCRIPTION OF THE DRAWINGS

FIG. 1 is a perspective view of the building block of the invention.

FIG. 2 is a sectional view along lines 2—2 of FIG. 1.

FIG. 3 is a sectional view along lines 3—3 of FIG. 1.

FIG. 4 is a bottom view of the building block of FIG. 1.

FIG. 5 an elevation view of the left end of the block of FIG. 1 as there depicted.

FIG. 6 is a perspective view of the innovative building block with alignment and insulation cores inserted into the block cells.

FIG. 7 is a sectional view along lines 7—7 of FIG. 6.

FIG. 8 is a sectional view along lines 8—8 of FIG. 6.

FIG. 9 is a plan view of two abutting block illustrating the manner in which the inserted cores control the length of a course of block.

FIG. 10 is a sectioned front elevation view of a portion of a wall illustrating the interplay of the inserted cores in controlling alignment, leveling, and running length of the several drystacked courses of block.

BEST MODES FOR CARRYING OUT THE INVENTION

Figure 11:
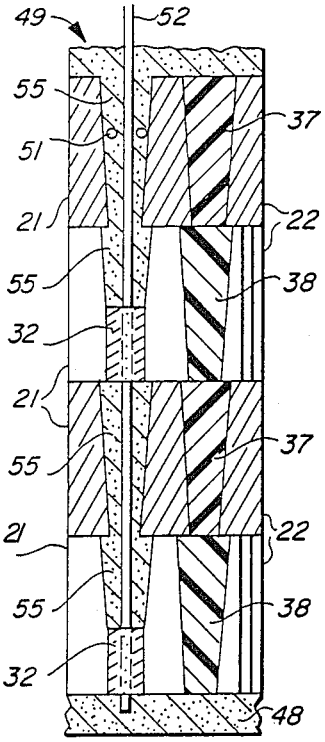
FIG. 11 is a sectioned side elevation view of a wall illustrating the use of mass aggregate filling to obtain a thermal flywheel effect within the interior side of a wall of a solar heated home.

For the purposes of promoting an understanding of the principles of the invention, reference will now be made to the embodiments illustrated in the drawings and specific language will be used to describe the same. It will, nevertheless, be understood that no limitation of the scope of the invention is thereby intended, such alterations and further modifications in the illustrated device, and such further applications of the principles of the invention as illustrated therein being contemplated as would normally occur to one skilled in the art to which the invention relates.

The innovative construction block disclosed in this specification will be seen to be so configured that certain aspects of its configuration may be maintained dimensionally precise from one construction block to another over the course of a long production run of such construction block. Advantage is then taken of these precise dimensional characteristics of certain aspects of the construction block to provide the means for drystacking these blocks in running courses for the erection of a standing wall, which running courses will be self-aligned and self-leveling. The geometry of the construction block provides for both elongated and reduced volume thermal pathways from one face of the block to the other. Insertable cores, utilized to make running courses of the block self-leveling, self-aligning, and mechanically interlocked, contribute to the insulative qualities of the block when the cores are fabricated of insulation materials. The invention disclosed herein is believed to be the first to provide a self-aligning, self-leveling, interlocked, drystacked wall structure capable of meeting such Code requirements as that of the Uniform Building Code of the International Congress of Building Officials (ICBO) and the building codes of the Building Official's Counsel of America (BOCA) and the Southern Building Code Congress of America (SBCCA). No known prior art building block so facilitates handling or so readily enables the introduction of bond beams and grout cores and associated reinforcing bars (re-bars) during the construction of an insulated drystacked standing wall.

Drystacking of blocks to produce a standing wall is economical, however, due to the loose dimensional standards dictated by the molding techniques employed in manufacturing construction block, masons, in general, prefer to use grout between blocks so that the level and alignment of each block may be individually controlled dispite the poor tolerances maintained in manufacture of the block. A major problem experienced in the molding of a significant number of construction blocks is that the blocks tend to grow in size. This is caused by the wearing away of the surfaces of the molds in which the blocks are cast. The concrete of which the blocks are comprised is highly abrasive and, as the walls of the mold are worn away by the constant abrasion of producing and removing block from the molds, the molds enlarge and, thus, the block produced at the end of a production run will, in general, be larger than the blocks produced earlier in the production run. The invention accounts for such tendencies of molded block to increase in size during the course of production run and provides the inherent means for monitoring such growth so that molds may be refurbished in a timely manner to maintain certain dimensions of the block in precise control and to prevent block growth in less critical areas from achieving such extensiveness as to defeat the intent of the invention.

FIG. 1 is a perspective illustration of construction block 20. The total geometry of block 20 will be better appreciated by consideration of FIGS. 2 through 5 in conjunction with FIG. 1. Block 20 is comprised of a first and second outside wall, 21 and 22 respectively, and a central web 23. Each of the outside walls, 21 and 22, contains a pair of conduit channels 24. The conduit channels 24 are symetrically emplaced such that when blocks 20 are arranged in running courses, the conduit channel 24 in a first running course of blocks 20 will align with the conduit channels 24 in the blocks 20 of a second running course. A pair of male interlock tangs 25 and 26 are presented at the left-hand end of the block 20 illustrated in FIG. 1. A pair of female interlocks, 27 and 28, are presented at the right-hand end of the block 20 illustrated in FIG. 1. Female interlock 28 is best seen in the bottom view of block 20 presented in FIG. 4. The void between outer wall 21 and central web 23 creates a tapered wall cell 28. As is best seen in FIG. 5, the inner surfaces of wall 21 and central web 23 are tapered. Reduced height, transverse webs 32 and 33 comprise a portion of the longitudinal bounds of cell 28. As is seen in FIG. 2, the interior surfaces of transverse webs 32 and 33 are also tapered. Thus, cell 28 is a tapered wall cell. When block 20 is molded, the mold can employed to form cell 28 will have a complementary taper to those presented at the interior of wall 21, central web 23 and transverse webs 32 and 33. When block 20 is released from the mold, the mold can forming cell 28 will be immediately released from contact with these tapering interior walls and there will be minimal wear on the tapered walls of the mold can over a long production run of concrete block. Experience leads one to anticipate that at least 500,000 and probably closer to 1,000,000 blocks may be molded before the geometry of the tapered walls departs from the precision required in practicing the invention. This compares with mold lifetimes of 100,000 to 125,000 uses in molding blocks whose walls have no tapered draft and whose surfaces constantly abraid the surfaces of the mold as the block is drawn from the mold.

The void between central web 23 and second wall 22 is comprised of two open-ended, tapered wall cells 29 and 30 and a central tapered wall cell 31. The tapered walls are produced by the tapering of the surfaces at the interior of central web 23 and wall 22 and the reduced height transverse webs 34 as may be observed in FIGS. 3 and 5.

A comparison of FIGS. 2 and 3 indicates that transverse webs 32 and 33 are displaced from transverse webs 34. Thus, a transverse plane would pass between web 32 and web 34 in cells 28 and 30 and a similar transverse plane would pass between web 33 and web 34 in cells 28 and 29. This displacement of transverse webs provides an elongated thermal conduction path P as indicated in FIG. 4. Thermal conduction through the block 20 is further impeded by the reduced heights of transverse webs 32, 33 and 34. These transverse webs are typically slightly more than one-half the height of block 20 and are determined to permit block 20 to have the necessary strength to meet the various building codes. The reduction of height of these transverse webs reduces the volume of the thermal conduction path from one wall of the block to the other.

The hollow cylinder formed by interior walls 35 and portions of exterior walls 21 and 22 which surround conduit channels 24 provide a columnar strength cylinder as well as making available a conduit for the passage of electrical wiring in a wall constructed from block 20.

Having provided a construction block whose interior tapered cell walls are maintained in precise dimension over a long manufacturing run of molding said block, means will now be disclosed wherein block 20 may be made self-aligning and self-leveling when layed in running courses for the erection of a standing wall. FIG. 6 is a similar perspective view of block 20 to that illustrated in FIG. 1. However, tapered wall cores of mating configuration to the cells of block 20 have been hereinserted. Core 36 has been inserted in cell 28, core 37 in cell 31 and core 38 in open-ended cell 30 such that core 38 extends beyond the longitudinal bounds of block 20. While cores 36, 37 and 38 may be molded of any material of which precise control of its dimensional characteristics may be maintained, fabricating cores 36, 37 and 38 of an insulative material, for example, a low-density foam insulation, will enhance the insulation qualities of block 20 and increase its utility in building construction. One of the more imprecise dimensions of a molded construction block is the height of the block. The height of the block varies with the amount of material impressed into the mold from which the block is manufactured. An over-height block is seldom, if ever, manufactured since it is almost impossible to remove such a block from the molding machine. Molded construction block therefor has a tendency to run slightly undersized from a standard height dimension, for example, 8 inches. By maintaining precise control of the height of cores 36, 37 and 38, a fixed precise height dimension will be established for the combination of block 20 with one or more cores 36, 37 and 38 inserted therein. Since the tapering of the walls of the cells 28 through 31 of block 20 enables blocks to be produced in which precise interior dimensions are maintained, the precisely dimensioned cores 36 through 38 will intimately fit within these interior cells of block 20 and permit the construction of a standing wall from running courses of block 20 predicated on the precision of emplacement and dimension of cores 36 through 38.

In the sectional view of FIG. 7 taken along line 7-7 of FIG. 6, core 36 is seen to extend longitudinally beyond the bounds of the concrete block. The ends of core 36 which extend beyond the longitudinal bounds of block 20 are configured in a similar shape to that of interlocks 25 and 28 incorporated in block 20 when it was manufactured. The extension of core 36 beyond the bounds of block 20 is shown by the arrows at 44 and 45 in FIG. 7.

FIG. 8 is a cross-sectional view taken along lines 8-8 of FIG. 6. Core 37 is seen to fit intimately within cell 31, FIGS. 1 and 3, conforming to the tapered walls of that cell. Core 38 is shown inserted within open-ended cell 30, FIGS. 1 and 3, making intimate contact with the walls of that cell as well as coming into intimate contact with core 37 along line 41. As can been seen, approximately one-half of core 38 extends beyond the bounds of open-ended cell 30 so as to extend well beyond the longitudinal limits of the concrete block. A similar core 38 is insertable within cell 29 and will likewise extend beyond the bounds of cell 29.

The purpose for extending cells 36 and 38 beyond the longitudinal bounds of block 20 will be seen in FIG. 9 which is a partial top-view of two adjacent blocks 201 and 202, placed end-to-end as in a running course as would be found in the erection of a standing wall. When the blocks are so emplaced, cores 36 make intimate contact along line 43. The left-hand end of core 38, as illustrated, makes intimate contact along line 42 with an adjacent core 37 while it makes similar intimate contact along line 41, to its right, with another core 37. Since all of the cores extend beyond the longitudinal bounds of the blocks, a gap is produced between blocks along lines C-C. For all practical purposes, this means that the running length of a course of block is determined by the precise dimensions of the cores 36 through 38 and the vagaries of length variations produced by mold wear in the manufacture of block is eliminated. In practice, a gap between concrete blocks of approximately one-eighth of an inch results when the blocks are set in running courses to erect a standing wall. Thus the concrete male interlocks 25 and 26 will mate with the adjacent female interlocks 28 and 29 respectively to form an open-gap interlock between blocks in a running course. Since drystacked blocks employed in the erection of a standing wall are generally coated with a surface bonding cement these open-gaped interlocks will accept the passage of such surface bonding cement within the gaps to provide a strong gapless interlock and increase the shear strength of the resulting standing wall. A typical surface bonding cement formulation will be found in United States Department of Agriculture Bulletin No. 374. Surface bonding cements are commercially available.

The intimate line contact maintained from core to core within a running course of blocks 20 further enhances the thermal resistivity of a standing wall constructed of such blocks especially when the cores are made of an insulative material.

As is readily apparent in FIGS. 6 and 8, cores 37 are provided with channels 39, one on top and two at the bottom, while cores 38 are provided with spurs 40, two at the top and one at the bottom. When blocks 20 with cores 37 and 38 inserted therein are layed in running courses, the spurs 40 in cores 38 will matingly interlock with channels 39 in cores 37 since a core 38 in one running course of block will be emplaced adjacent a core 37 in a second running course of block. This arrangement is clearly indicated in the cross-sectional view of a standing wall illustrated in FIG. 10. The interlocking of spurs 40 and channels 39 prevents individual blocks from skewing and thus contributes to the self-alignment of the blocks in a running course. The interlocking of tangs 40 and channels 39 complements the action of core 38 as it extends from a half-cell 30 in one block to a half-cell 29 in an adjacent block.

The sectional view of the standing wall shown in FIG. 10 also illustrates the ease with which the invention is accomodated to meeting local building codes. Many local building codes require there be a continuous vertical grout column approximately every four feet along the running length of the wall. Such a column is known as a grout cell and is referenced in FIG. 10 as 50. Reinforcing bar 52 is placed within the grout cell 50 in accordance with local building code standards. Provision is made for establishing such a continuous vertical column of grout 50 by the elimination of selected cores 38 and 39 from blocks 20 so that a continuous vertical void remains in the standing wall erected of running courses of such block. Reinforcing bar 52 is then inserted into the voids established by the removal of such cores and grout is filled into the voids to establish the required grout cell 50.

Local building codes also frequently require that a bond beam be established for each four feet of height of the standing wall. In conventional block-constructed wall, the mason must emplace a liner beneath the row of block selected for the establishment of a bond beam. The liner is to prevent grout from running downwards through the open cell structure of the conventional block wall. The bond beam 49 shown in FIG. 10 comprises a continuous horizontal beam of grout formed by, in FIG. 10, the removal of all cores 37 and 38 from a running course of block, laying in reinforcing bar 51 and then filling the voids which remain with grout. The cells 37 and 38 which are present in the lower cores of block prevent grout from moving downward from the bond beam to lower levels of the standing wall.

In FIG. 10 it is noted the ease with which reinforcing bars 51 are emplaced within the bond beam 49. The reduced height of transverse webs 34 permits the ready placement of reinforcing bars 51 within the confines of blocks 20. In conventional construction block, the mason must chip away portions of the transverse webs in order to provide for reinforcing bars when a bond beam is to be constructed. No such difficulty is presented the mason when the innovative block here disclosed is employed.

Also shown in FIG. 10 is the manner in which channels 39 and spurs 40 interlock. This interlocking action is referenced 53. A further advantage of channels 39 and spurs 40 is indicated at the junction between the footing 48 and the first running course of block. When the block is layed on the footing the grout rises into channels 39 while spurs 40 descend into the grout helping to interlock the first running course of block with the footing. Similarly, when a bond beam 49 is constructed, the grout moves downward into channels 39 of the cores in the running course below the bond beam while spurs 40 extend upward into the grout of the bond beam.

While the necessity to provide bond beams and grout cells in accordance with local building codes is enhanced by the use of the invention, the incorporation of such structural features tends to degrade the thermal resistivity of the standing wall so constructed. However, in the wall of FIG. 10, the insulative core 36 will be present and will mitigate the adverse effect of bond beam 49 and grout cell 50 on the thermal conductivity of the standing wall so constructed.

In many energy conserving housing designs it is often advantageous to have a heat sink comprised of a mass of material which will assume the interior environmental temperature and act as a stabilizer, tending to produce a thermal flywheel effect and to delay rapid changes in the interior temperature. In FIG. 11 is illustrated a cross-section of a portion of a standing wall constructed of running coursed of the blocks 20 including a massive aggregate in one portion of the wall to provide for a thermal flywheel effect. In the wall of FIG. 11 insulative core 36 has been eliminated from all of blocks 20. The voids produced by the elimination of cores 36 are filled with a massive aggregate 55. Reinforcing bars may be incorporated at required height intervals where local building codes require a bond beam. A layer of grout 49 between courses will comprise a part of the bond beam. At required intervals along the length of the wall, reinforcing bars 52 may be inserted where the building codes require a grout cell. While the interior side of such a wall will comprise the massive aggregate to yield a thermal flywheel effect,the exterior side of the wall will include insulative cores 37 and 38 to reduce the heating effect of the exterior environment on environment interior of the wall.

While it is conventional that a drystacked block constructed wall be bonded with a surface binding cement, certain blocks which might be advantageously drystacked, do not lend themselves to surface bonding because of the particular desirable surface characteristics presented in a standing wall made up of running courses of such block. A typical block popular in the southwestern regions of the United States, known as a slump block, has such desirable surface characteristics which the masons tape pains to preserve during the construction of a standing wall. A need exists which will permit the drystacking of blocks with desirable surface characteristics and which will later permit the bonding of such blocks without detriment to such surface characteristics.

Figure 12A:
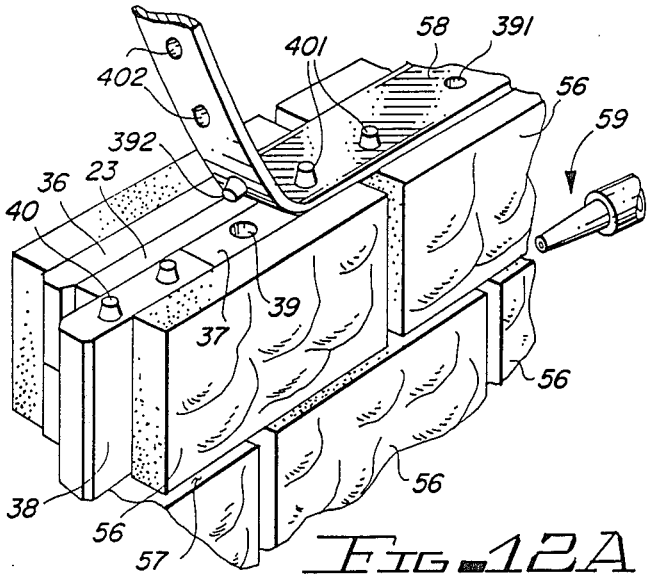
FIG. 12A illustrates the use of a spacer strip to maintain alignment while providing for the incorporation of grout between blocks when surface bonding cement is not used.
Figure 12B:
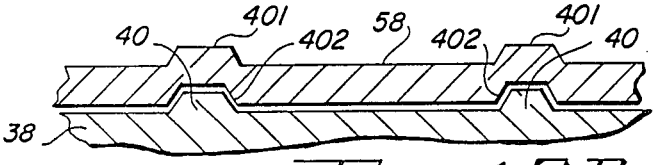
FIGS. 12B and 12C illustrate details of the spacer strip of FIG. 12A.
Figure 12C:
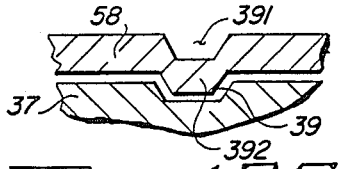

In FIG. 12A blocks 56, having desirable surface characteristics are intended for drystacking. The interior of the block is similar to block 20 illustrated in FIG. 1 having a central web, an elongated cell 28, a central cell 31 and two open-ended cells 29 and 30. As earlier described, cores 36, 37 and 38 are inserted in their respective cells of the block and the block layed in running courses. A spacer strip 58 is layed along the top of each running course. Such a spacer strip 58 is indicated in FIG. 12A. Strip 58 combines a channel 391 at the top of the strip with a spur 392 at the bottom of the strip to mate with a channel 39 in core 37. So to strip 58 includes a tang 41 at its upper surface with a channel 402 thereunder for mating with tangs 40 of cores 38. The details of this arrangement are illustrated in FIGS 12B and 12C. As with the earlier embodiment 20 of the building block, the arrangement of FIG. 12A permits the lengths of the running courses to be established by the intimate contact and the controlled length of cores 36, 37 and 38, the wall itself is controlled in height by the intimate contact of these cores and the precise control of their height; and the level of each course is established by the fact that cores are in intimate contact from top to bottom of the wall so erected. However, the incorporation of spacer strip 58 provides a gap or space 57 between each running course of block 56 as well as between adjacent blocks 56. A grout pipe 59 may then be employed to fill the spaces 57 with grout so as to bond the individual drystacked blocks one to another while preserving the desirable surface characteristics of blocks 56.

Figure 13:
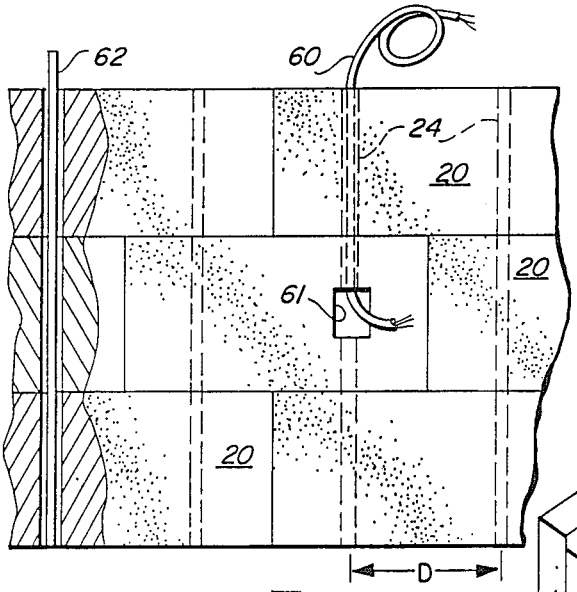
FIG. 13 illustrates the utility of pre-cast electrical conduits within the innovative block.

The introduction of conduit channels 24 within the walls of blocks 20 not only provides a columnar strength cylinder but also provides ready access for wiring which may be introduced from the top or bottom of a wall erected of running courses of block 20. The mason erecting the wall need not be informed or take into account the wiring plans for a building erected with such a wall. Rather, the electrician will recognize that there are readily available electrical conduit channels incorporated within the wall at regular spacing; for example, eight inches on center as illustrated in FIG. 13. Here an electrical wire 60 is introduced at the top of the wall through a conduit 24 to an opening 61 made in the wall by the electrician for the incorporation of an electrical junction box.

Figure 14:
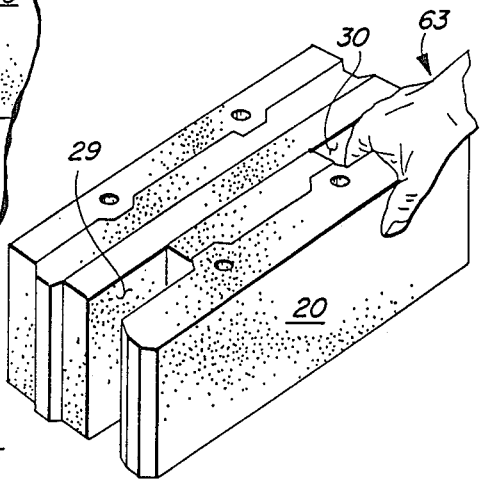
FIG. 14 illustrates the ease of handling the block while selected core inserts are in place.

As has been earlier pointed out, one disadvantage of prior art insultated blocks has been the fact that they were difficult to handle by a mason working on-site. As FIG. 14 illustrates, blocks 20 may be provided at the manufacturing site with cores 36 and 37 in place. This leaves open-ended cells 29 and 30 open so that the mason may place his hand 63 so that the fingers extend within one of these voids and readily lift the block one-handedly.

The invention provides an inherent method for monitoring the dimensions of blocks 20 as they are molded at the manufacturing facility. If the blocks grow in length due to wear on the sides of the mold, core 36 will no longer extend beyond the longitudinal bounds of the block. Thus, as the length of the block produced by a mold increases and approaches the length of core 36, the manufacturer is alerted to refurbish the mold. Similarly, the draft on the walls of the cells of the block which provides an immediate release of the mold cans with minimal wear thereof results in an extended life of such mold cans. Nevertheless, such wear is present and is accumulative. As the mold cans wear, the cells within the block decrease in volume. Such a decrease in volume will mean that the precisely dimensioned cores will no longer fit intimately within the cells of the block. This will signal the manufacturer that the mold cans need refurbishing.

What has been disclosed is a construction block with interior tapered wall cells. The tapering of the walls provides precisely maintained interior geometry for a long life time of use of the molds employed in manufacture of such block. Insertable cores of precise dimension to fit intimately within such cells and to come into intermittent contact with similar cells in adjacent blocks in a running course of said blocks and with similar cells in adjacent blocks in adjacent courses of said cells provide for the erection of a standing wall from drystacked running courses of such block wherein such running courses are self-aligned and self-leveling. The intimate contact of the insertable cores permit the formation of open-gapped interlocks between blocks and running courses, which open-gapped interlocks may be converted to closed-gapped interlocks when a wall erected of such running courses is coated with a surface bonding cement.

Those skilled in the art will conceive of other embodiments of the invention which may be drawn from the teachings herein. To the extent that such other embodiments are so drawn it is intended that they shall fall within the ambit of protection provided by the claims appended hereto.

Having described our invention in the foregoing specification and the accompanying drawings in such a clear and concise manner that those skilled in the art may readily understand and practice the invention, that which we claim is:

1. A method for erecting a drystacked block wall which is self-leveling and self-aligning comprising the steps of A. providing a sufficient quantity of tapered interior wall, hollow celled block for the wall to be erected;

B. providing precision dimensioned, tapered wall, interlocking cell cores for insertion with intimate tapered wall contact within selected tapered interior wall hollow cells of the blocks provided in step A;

C. inserting a cell core in a selected tapered interior wall hollow cell of each block of a first dry stacked running course of block in the wall to be erected for interlocking alignment in a cell core inserted in a selected tapered interior wall hollow cell of each block in a second drystacked running course of block in said wall to be erected; and D. utilizing the intimate tapered wall contact and the precision dimensions and interlocking of said cell cores to maintain the wall to be erected in vertical and horizontal alignment by aligning cell core to cell core to control the position of each block relative to each adjacent block in the wall to be erected.

2. The method of claim 1 wherein Step A further includes selecting hollow celled block having interlocking ends permitting the mechanical interlock of adjacent block in a running course of the wall to be erected to increase the shear strength of said wall.

3. The method of claim 1 further comprising the step of applying surface bonding cement to the surfaces of the drystacked blocks, aligned and leveled by said cell cores.

4. The method of claim 2 further comprising the step of applying surface bonding cement to the surfaces of the drystacked blocks, aligned and leveled by said cell cores.

5. The method of claim 1 wherein step B further includes selecting precision dimensioned, interlocking cell cores of insulating material.

6. The method of claim 5 wherein step C further includes inserting at least one of interlocking and noninterlocking insulating cell cores in selected remaining hollow cells in a running course of drystacked block to provide an insulated block structure for the wall to be erected.

7. The method of claim 6 further comprising the step of applying surface bonding cement to the surfaces of the drystacked blocks, aligned and leveled by said cell cores.

8. The method of claim 5 wherein step A further includes selecting hollow celled block with a continuous central web, the hollow cells positioned on both sides of said central web.

9. The method of claim 8 wherein step B further includes inserting at least one of interlocking and noninterlocking insulating cell cores in selected remaining hollow cells in a running course of drystacked block to provide an insulated block structure for the wall to be erected.

10. The method of claim 9 further comprising the step of applying surface bonding cement to the surfaces of the dry stacked blocks, aligned and leveled by said cell cores.

11. The method of claim 8 wherein step B includes selecting hollow cells of said block on a predetermined side of said continuous central web for insertion of the precision dimensioned interlocking cell cores provided; and step C includes inserting at least one of interlocking and non-interlocking insulating cell cores in selected remaining hollow cells in a running course of drystacked block on said predetermined side of said continuous center web to provide a block structure for the wall to be erected insulated on said predetermined side of said central web.

12. The method of claim 11 wherein step C includes inserting at least one of interlocking and non-interlocking insulating cell cores in selected remaining hollow cells in a running course of drystacked block on the side opposite of said predetermined side of said continuous web to provide a block structure for the wall to be erected insulated on both sides of said central web.

13. The method of claim 12 including the further step of utilizing selected remaining hollow cells in a running course of drystacked block for bond beams and grout cells as required by local building codes.

14. The method of claim 13 further comprising the step of applying surface bonding cement to the surfaces of the drystacked blocks, aligned and leveled by said cell cores.

15. The method of claim 11 further comprising the step of inserting an aggregate mass in all remaining hollow cells in a running course of drystacked block on the side opposite of said predetermined side of said continuous web to provide a block structure for the wall to be erected insulated on said predetermined side of said central web and providing a thermal flywheel mass on the opposite side of said central web.

16. The method of claim 15 including the further step of utilizing selected remaining hollow cells in a running course of drystacked block for bond beams and grout cells as required by local building codes.

17. The method of claim 16 further comprising the step of applying surface bonding cement to the surfaces of the drystacked blocks, aligned and leveled by said cell cores.

18. The drystack block wall produced by the method of claim 3.

19. The drystack block wall produced by the method of claim 4.

20. The drystack block wall produced by the method of claim 7.

21. The drystack block wall produced by the method of claim 10.

22. The drystack block wall produced by the method of claim 14.

23. The drystack block wall produced by the method of claim 17.

* * * * *